US007597050B2

(12) United States Patent
Waisanen

(10) Patent No.: US 7,597,050 B2
(45) Date of Patent: Oct. 6, 2009

(54) CRANE RETURN

(75) Inventor: Steven K. Waisanen, Big Bend, WI (US)

(73) Assignee: MHE Technologies, Inc., Wilmington, DE (US)

( * ) Notice: Subject to any disclaimer, the term of this patent is extended or adjusted under 35 U.S.C. 154(b) by 316 days.

(21) Appl. No.: 10/563,775

(22) PCT Filed: Aug. 1, 2005

(86) PCT No.: PCT/US2005/027282

§ 371 (c)(1),
(2), (4) Date: Jan. 6, 2006

(87) PCT Pub. No.: WO2007/015693

PCT Pub. Date: Feb. 8, 2007

(65) Prior Publication Data

US 2007/0125258 A1 Jun. 7, 2007

(51) Int. Cl.
*B61D 1/00* (2006.01)
*B61B 3/00* (2006.01)
*B66C 17/00* (2006.01)

(52) U.S. Cl. ..... 105/163.1; 104/90; 212/312

(58) Field of Classification Search ..... 105/27, 105/148, 157.1, 163.1, 163.2; 104/89, 90, 104/154, 287, 288; 212/312, 316
See application file for complete search history.

(56) References Cited

U.S. PATENT DOCUMENTS 894,916 A 8/1908 Strobel et al.
3,192,119 A 6/1965 Hosegood et al.
3,972,420 A 8/1976 Stock et al.
4,576,100 A * 3/1986 Zanin ..... 105/49
4,597,497 A 7/1986 Aberegg
4,635,802 A 1/1987 Hylton
4,718,539 A 1/1988 Fukuwatari et al.
4,730,743 A 3/1988 Rosman
4,836,111 A 6/1989 Kaufmann
2004/0026349 A1 2/2004 Colgate et al.

* cited by examiner

*Primary Examiner*—S. Joseph Morano
*Assistant Examiner*—Robert J McCarry, Jr.
(74) *Attorney, Agent, or Firm*—Porter, Wright, Morris & Arthur, LLP

(57) ABSTRACT

A crane return system is used for returning a crane component to a home position when there is a loss of power. A crane includes a bridge with a plurality of main wheels adapted to travel along at least one rail. The crane return system includes a plurality of auxiliary drive wheels supported by the bridge, the auxiliary drive wheels movable between a first position, in which the auxiliary drive wheels are recessed from the rail, and a second position, in which the auxiliary drive wheels are in contact with the rail. When power is supplied to the crane return system the auxiliary drive wheels are in the first position. A hydraulic fluid pressure vessel stores hydraulic fluid, wherein a substantially fixed mass of hydraulic fluid is contained within the crane return system, and a hydraulic cylinder is interconnected with the auxiliary drive wheels and selectively fluidly communicates with the hydraulic fluid pressure vessel. When power is lost to the crane, hydraulic fluid is supplied to the hydraulic cylinder to extend the hydraulic cylinder and thereby move the auxiliary drive wheels from the first position to the second position. A drive motor is interconnected with the auxiliary drive wheels and selectively fluidly communicates with the hydraulic fluid pressure vessel. When the auxiliary drive wheels are in the second position, hydraulic fluid is diverted from the hydraulic cylinder and supplied to the drive motor to rotate the auxiliary drive wheels and move the bridge toward a home position.

25 Claims, 6 Drawing Sheets

CRANE RETURN

BACKGROUND

The present invention relates to a return system for returning a crane to a home position upon loss of power to the crane.

Conventional overhead cranes include a frame with a pair of bridge cross members that move along a pair of main support beams. A pair of rails are supported by the cross members and a hoist moves along the pair of rails in a direction transverse to the main support beams. Some cranes are used to store and retrieve containers holding radioactive materials or other hazardous materials. Oftentimes, the containers are stored within tunnels inside a mountain or other facility that people cannot enter and the crane transports the containers to and from storage positions within the tunnels. Because of the hazardous nature of the container contents and the tunnels, there is a barrier sealing the tunnel that people cannot pass. Once the crane passes the barrier, it could become stranded due to power failure, power loss to the crane, or failure of a component within the crane. As a result, no one can reach the crane to repair it due to the hazardous nature of the tunnels.

One retrieval solution uses a rope or chain, with one end attached to the crane and another end located outside the barrier, to pull the crane back to a home position or a position outside the barrier where repairs can occur. However, due to the tunnel length, use of a rope to pull the crane back is not feasible or efficient. Further, the crane may not be able to roll back to the barrier because of the power loss. Another solution uses another device that moves along the rails to retrieve the crane, however, this solution is also limited if the crane cannot roll due to the power loss.

SUMMARY

In one embodiment, the invention provides a crane return system for returning a crane component to a home position when there is a loss of power. A crane includes a bridge adapted to travel along at least one rail and includes a plurality of main wheels to travel along the rail. The crane return system includes a plurality of auxiliary drive wheels supported by the bridge, the auxiliary drive wheels movable between a first position, in which the auxiliary drive wheels are recessed from the rail, and a second position, in which the auxiliary drive wheels are in contact with the rail, wherein when power is supplied to the crane return system the auxiliary drive wheels are in the first position. The crane return system includes a hydraulic fluid pressure vessel for storing hydraulic fluid, wherein a substantially fixed mass of hydraulic fluid is contained within the crane return system, and a hydraulic cylinder interconnected with the auxiliary drive wheels and selectively fluidly communicating with the hydraulic fluid pressure vessel. When power is lost to the crane, hydraulic fluid is supplied to the hydraulic cylinder to extend the hydraulic cylinder and thereby move the auxiliary drive wheels from the first position to the second position. A drive motor is interconnected with the auxiliary drive wheels and selectively fluidly communicates with the hydraulic fluid pressure vessel, wherein when the auxiliary drive wheels are in the second position, hydraulic fluid is diverted from the hydraulic cylinder and supplied to the drive motor to rotate the auxiliary drive wheels and move the bridge toward a home position.

In another embodiment, the invention provides a crane comprising a bridge adapted to travel along a pair of rails, the bridge including a plurality of main wheels and a plurality of auxiliary drive wheels. The auxiliary drive wheels are movable between a first position, in which the auxiliary drive wheels are recessed from the rails when power is supplied to the crane, and a second position, in which the auxiliary drive wheels are in contact with the rails when power is off to the crane. The crane also includes a hydraulic fluid pressure vessel filled with hydraulic fluid and a hydraulic cylinder interconnected with the auxiliary drive wheels and selectively fluidly connected with the hydraulic fluid pressure vessel. When power is lost to the crane, hydraulic fluid is delivered from the hydraulic pressure vessel to the hydraulic cylinder to extend the hydraulic cylinder and thereby move the auxiliary drive wheels from the first position to the second position. A drive motor is interconnected with the auxiliary drive wheels and selectively fluidly connected with the hydraulic fluid pressure vessel, wherein when the auxiliary drive wheels are in the second position, hydraulic fluid is diverted from the hydraulic cylinder and delivered from the hydraulic fluid pressure vessel to the drive motor to rotate the auxiliary drive wheels and move the bridge toward a home position.

In another embodiment the invention provides a method of returning a crane component to a home position upon a loss of power to the crane. A crane includes a bridge adapted to travel along at least one rail with a plurality of main wheels in contact with the rail and a plurality of auxiliary drive wheels recessed from the rail. The method includes supplying and storing hydraulic fluid in a hydraulic fluid pressure vessel. Upon a loss of power to the crane, hydraulic fluid is supplied from the hydraulic fluid pressure vessel to a hydraulic cylinder interconnected with the auxiliary drive wheels, the hydraulic cylinder extending to move the auxiliary drive wheels into contact with the rail. Hydraulic fluid is supplied from the hydraulic fluid pressure vessel to a drive motor when the auxiliary drive wheels contact the rail to drive the auxiliary drive wheels such that the bridge travels along the rail toward the home position, wherein hydraulic fluid is diverted from the hydraulic cylinder. Flow of hydraulic fluid is stopped to the drive motor when the bridge reaches the home position to thereby stop the auxiliary drive wheels.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
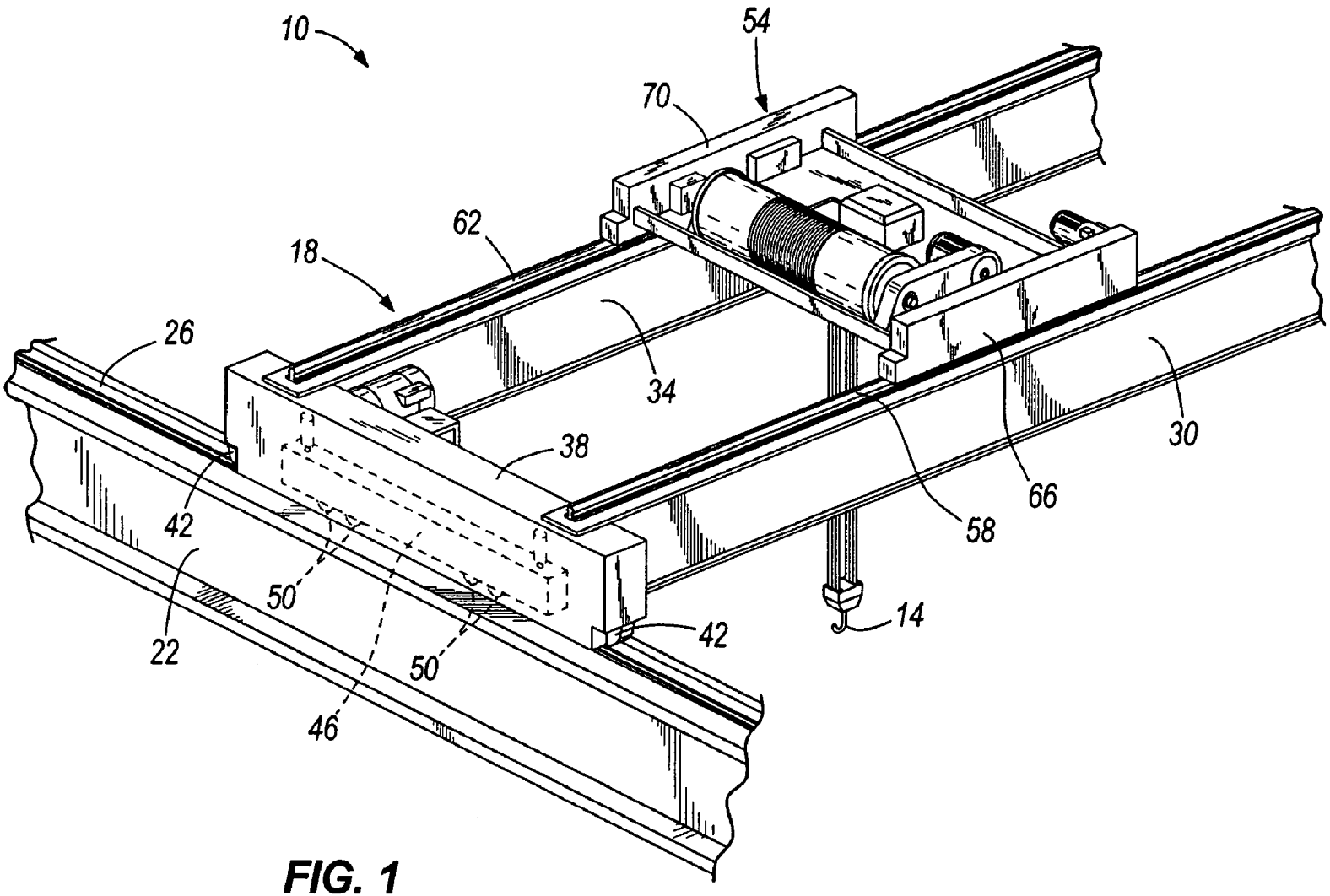
FIG. 1 is a perspective view of a crane.

FIG. 1 illustrates an overhead crane 10 that positions a hoist 14 in a crane bay for lifting and unloading a load. The overhead crane 10 includes a bridge 18 that translates along a first main support beam 22 and a second main support beam (not shown). The main support beams 22 generally extend between two walls (not shown) of a facility and are spaced apart and generally parallel to each other. As will be readily known to those of skill in the art, the main support beams 22 may alternatively be curved to match the inside wall contours of a round building, or include a single, curved support beam.

In the illustrated embodiment, top surfaces of the first and second main support beams 22 define rails 26 that the bridge 18 travels along. The bridge 18 includes a first girder 30, a second girder 34, and a pair of end trucks 38 that extend between the first and second girders 30, 34 (only one end truck 38 is shown in FIG. 1). The end trucks 38 or U-shaped channel members, are aligned generally parallel to the main support beams 22. Each end truck 38 defines a passage for receiving one of the main support beam rails 26. Main wheels 42 are disposed in each passage to facilitate travel of the bridge 18 along the rails 26. As will be readily known to those of skill in the art, any number of driven wheels may be disposed in the end trucks 38. Further, idle wheels may be disposed in the end trucks 38 to facilitate travel of the bridge 18 along the main support beams 22.

The end truck 38 shown in FIG. 1 supports an auxiliary end truck 46 that includes a plurality of auxiliary drive wheels 50. The auxiliary drive wheels 50 are movable between a first position, in which the wheels 50 are recessed from the rails 26 (as seen in FIG. 1), and a second position, in which the wheels 50 are in contact with the rails 26. Although only one end truck 38 is shown in FIG. 1, in a further embodiment, an auxiliary end truck and auxiliary drive wheels are also positioned at the second end truck of the bridge 18.

The first and second girders 30, 34 are spaced apart from each other and generally parallel. The girders 30, 34 are aligned transversely to the main support beams 22. A trolley 54, or second bridge, travels along girder rails 58, 62 that are positioned on top surfaces of the first and second girders 30, 34. The trolley 54 includes a pair of end trucks 66, 70 that are aligned generally parallel to the first and second girders 30, 34. Each end truck 66, 70 defines a passage for receiving one of the girder rails 58, 62. Wheels (not shown) are disposed in each passage to facilitate travel of the trolley 54 along the rails 58, 62. As will be readily known to those of skill in the art, any number of driven wheels may be disposed in the end trucks 66, 70. Further, idle wheels may be disposed in the end trucks 66, 70 to facilitate travel of the trolley 54 along the first and second girders 30, 34. As discussed below, in a further embodiment the end trucks 66, 70 each include an auxiliary end truck with movable auxiliary drive wheels. As used herein, bridge is a movable carriage of the crane and includes the main bridge, the trolley carrying the hoist, or the like.

FIGS. 2-6 are schematic diagrams illustrating a crane return system 80 for returning the crane 10 to a home position upon loss of power, power failure or mechanical failure of a crane component, and also illustrate sequence of operations for the crane return system 80. The crane return system 80 includes the main end truck 38 including main wheels 42, the auxiliary end truck 46 including auxiliary drive wheels 50, a hydraulic fluid pressure vessel 84, a pair of hydraulic cylinders 88, a hydraulic reservoir 92, a pump 96, a hydraulic drive motor 100, and multiple limit switches and valves as discussed below. In the illustrated embodiment, the main end truck 38 forms part of the bridge 18 and supports the main wheels 42, which travel along one of the rails 26 of the main support beams 22 during normal operation of the crane. The auxiliary end truck 46 is supported by the main end truck 38 and includes the auxiliary drive wheels 50. The auxiliary drive wheels 50 are movable between a first position (shown in FIGS. 2 and 6), in which the wheels 50 are recessed from the rail 26 of the main support beam 22, and a second position (shown in FIGS. 3-5), in which the wheels 50 are in contact with the rail 26.

The hydraulic fluid pressure vessel 84 stores hydraulic fluid, wherein a substantially fixed mass of hydraulic fluid is contained within the crane return system 80. The hydraulic cylinders 88 are coupled to the auxiliary end truck 46 and fluidly communicate with the fluid pressure vessel 84. When the cylinders 88 extend, the auxiliary end truck 46 moves toward the rail 26 to thereby move the auxiliary drive wheels 50 to the second position and bring the wheels 50 in contact with the rail 26. When the cylinders 88 retract, the auxiliary end truck 46 retracts away from the rail 26 to thereby move the auxiliary drive wheels 50 to the first position and recess the wheels 50 from the rail 26. A normally-closed power loss valve 104 regulates flow of hydraulic fluid from the fluid pressure vessel 84 to the cylinders 88.

The hydraulic drive motor 100 is electrically connected to the auxiliary drive wheels 50 and fluidly communicates with the hydraulic fluid pressure vessel 84. When the drive motor 100 receives hydraulic fluid from the fluid pressure vessel 84, the drive motor 100 causes rotation of the auxiliary drive wheels 50 to move the bridge 18 along the rails 26 of the main support beams 22. A wheel down valve 108 regulates flow of hydraulic fluid from the fluid pressure vessel 84 to the drive motor 100 and flow of hydraulic fluid from the fluid pressure vessel 54 to the hydraulic cylinders 88. The wheel down valve is shown as a three-way valve in FIGS. 2-6. Further, a normally-open home position valve 112 regulates flow of hydraulic fluid to and from the drive motor 100.

The hydraulic fluid reservoir 92 fluidly communicates with the hydraulic cylinders 88, the hydraulic drive motor 100, and the hydraulic fluid pressure vessel 84. The fluid reservoir 92 receives hydraulic fluid from the cylinders 88 and the drive motor 100 and stores the hydraulic fluid until the pump 96 pumps the hydraulic fluid to the fluid pressure vessel 84. A normally-closed system reset valve 116 directs flow of hydraulic fluid from the fluid reservoir 92 to either the fluid pressure vessel 84 or the cylinders 88.

Figure 2:
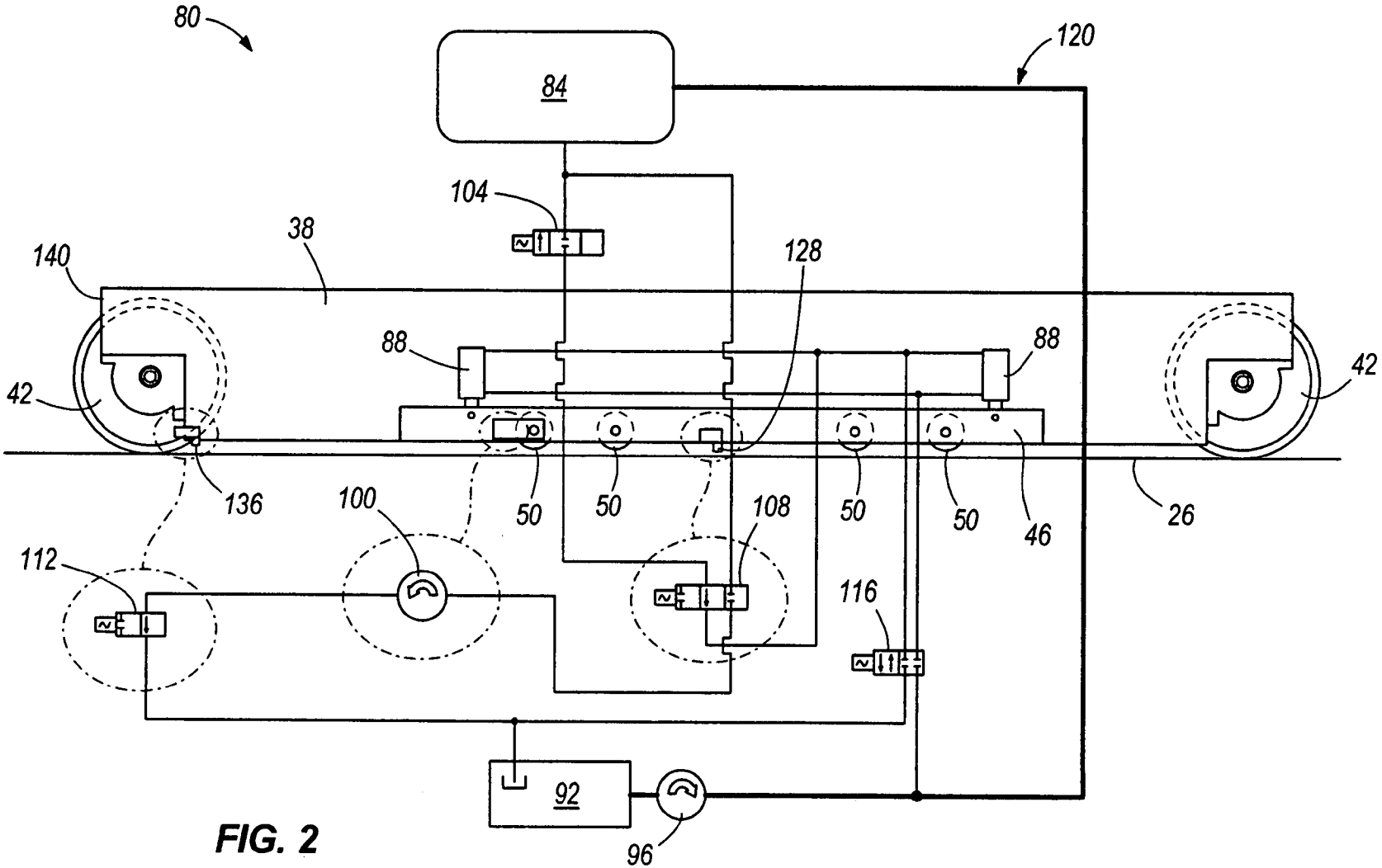
FIGS. 2-6 are schematic diagrams that illustrate a sequence of operations for a crane return system embodying the invention.

FIG. 2 illustrates the crane return system 80 when power is supplied to the crane 10, i.e., during normal operation of the crane 10. In FIG. 2, the main wheels 42 are in contact with the rail 26 such that the main wheels 42 travel along the rail 26 to move the bridge 18. The auxiliary drive wheels 50 are in the first position, recessed from the rail 26, and the hydraulic cylinders 88 are retracted. While power is supplied to the crane 10, hydraulic fluid in the hydraulic fluid reservoir 92 is pumped to the hydraulic fluid pressure vessel 84, shown by a hydraulic fluid flow path 120 (bold line in FIG. 2). The fluid pressure vessel 84 sits as potential energy. Once the fluid pressure vessel 84 is full, a pressure relief valve reroutes hydraulic fluid back to the fluid reservoir 92.

In FIG. 2, the power loss valve 104 is closed to prevent hydraulic fluid from exiting the hydraulic fluid pressure vessel 84 to the hydraulic cylinders 88. The system reset valve 116 is closed to prevent hydraulic fluid being pumped from the hydraulic fluid reservoir 92 from entering the cylinders 88. The wheel down valve 108 is positioned to prevent hydraulic fluid from exiting the fluid pressure vessel 84 and entering the hydraulic drive motor 100 to energize the drive motor 100. When power is supplied to the crane 10, the home position valve 112 is open, however, no hydraulic fluid passes through the valve 112 because the wheel down valve 108 is closed.

Figure 3:
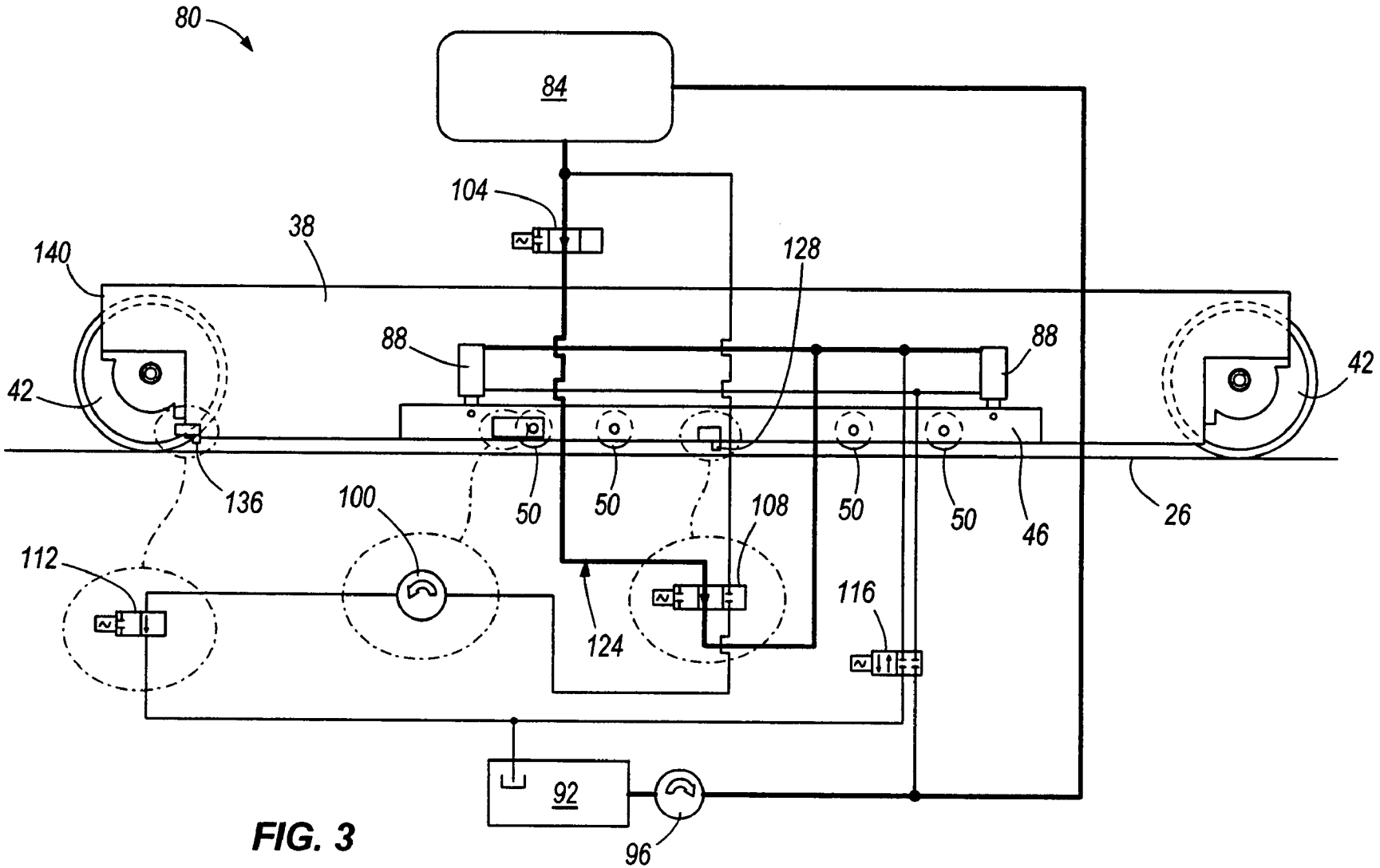

FIG. 3 illustrates the crane return system 80 immediately upon loss of power to the crane 10. The crane return system 80 is deployed when power failure to the crane 10 occurs or power is purposefully cut to the crane 10, such as when a crane component fails. Upon loss of power to the crane 10, the normally-closed power loss valve 104 opens to allow hydraulic fluid to flow from the hydraulic fluid pressure vessel 84 to the hydraulic cylinders 88. Hydraulic fluid delivered to the cylinders 88 causes the cylinders 88 to extend, thereby extending the auxiliary end truck 46 towards the rail 26 of the main support beam 22 until the auxiliary drive wheels 50 come in contact with the rail 26. A hydraulic fluid flow path 124 is shown by a solid, bold line in FIG. 3. Hydraulic fluid from the fluid pressure vessel 84 flows through the power loss valve 104 and through the wheel down valve 108 to the cylinders. The wheel down valve 108 is positioned to allow hydraulic fluid to flow from the fluid pressure vessel 84 to the cylinders 88, but not to the hydraulic drive motor 100. In the illustrated embodiment, the power loss valve 104 regulates flow of hydraulic fluid at a pre-determined flow rate to apply pressure to the cylinders 88. Upon loss of power to the crane 10, the home position valve 112 and the system reset valve 116 are not actuated. The pump 96 continues to pump any hydraulic fluid remaining in the hydraulic fluid reservoir 92 to the fluid pressure vessel 84.

Figure 4:
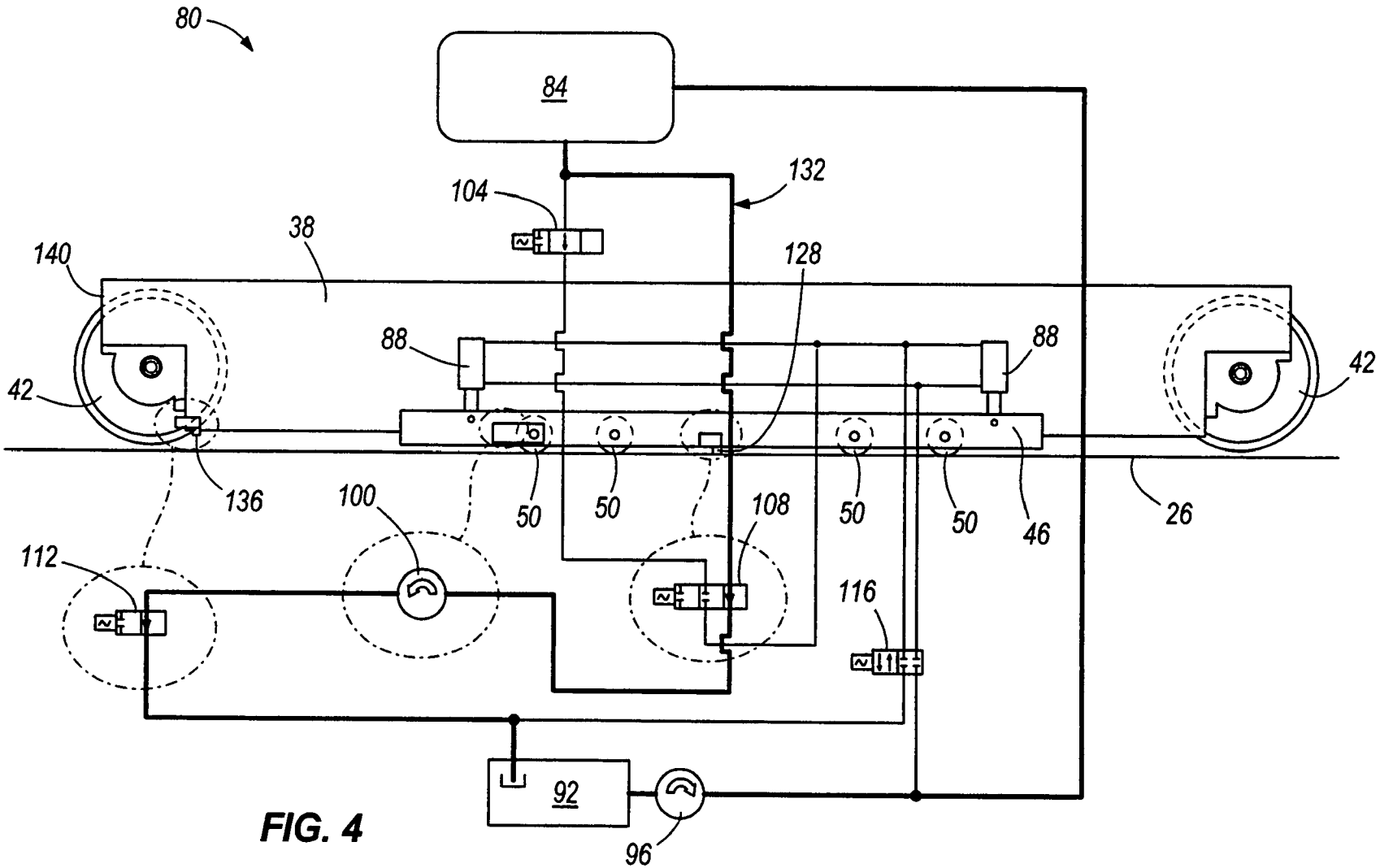

FIG. 4 illustrates the crane return system 80 after the auxiliary drive wheels 50 contact the rail 26 of the main support beam 22. A wheel down limit switch 128 is coupled to the wheel down valve 108 and positioned adjacent the auxiliary drive wheels 50. In the illustrated embodiment, the wheel down limit switch 128 is located on the auxiliary end truck 46. When the auxiliary drive wheels 50 contact the rail 26, the wheel down limit switch 128 contacts the rail 26 and actuates the wheel down valve 108 to allow hydraulic fluid to flow from the hydraulic fluid pressure vessel 84 to the hydraulic drive motor 100. Thus, the wheel down valve 108 is positioned to prevent flow from the fluid pressure vessel 84 to the hydraulic cylinders 88 and the cylinders 88 stop extending. A hydraulic fluid flow path 132 is shown by the solid, bold line in FIG. 4.

Force from the auxiliary drive wheels 50 contacting the rail 26 lifts the main wheels 42 from contact with the rail 26 and the main end truck 38 retracts from the rail 26. Hydraulic fluid is delivered to the hydraulic drive motor 100 from the hydraulic fluid pressure vessel 84, via the wheel down valve 108. The hydraulic fluid energizes the drive motor 100, which rotates the interconnected auxiliary drive wheels 50 to thereby move the bridge 18 along the rails 26 of the main support beams 22 and towards the home position. In the illustrated embodiment, the drive motor 100 is supported by the auxiliary end truck 46.

During this phase of the crane return, the home position valve 112 and the system reset valve 116 remain in the respective initial position. The home position valve 112 remains open to permit hydraulic fluid to flow from the hydraulic drive motor 100 to the hydraulic fluid reservoir 92, whereby the pump 96 pumps hydraulic fluid back to the hydraulic fluid pressure vessel 84. The system reset valve 116 remains positioned to prevent hydraulic fluid from the fluid reservoir 92 from flowing to the hydraulic cylinders 88.

Figure 5:
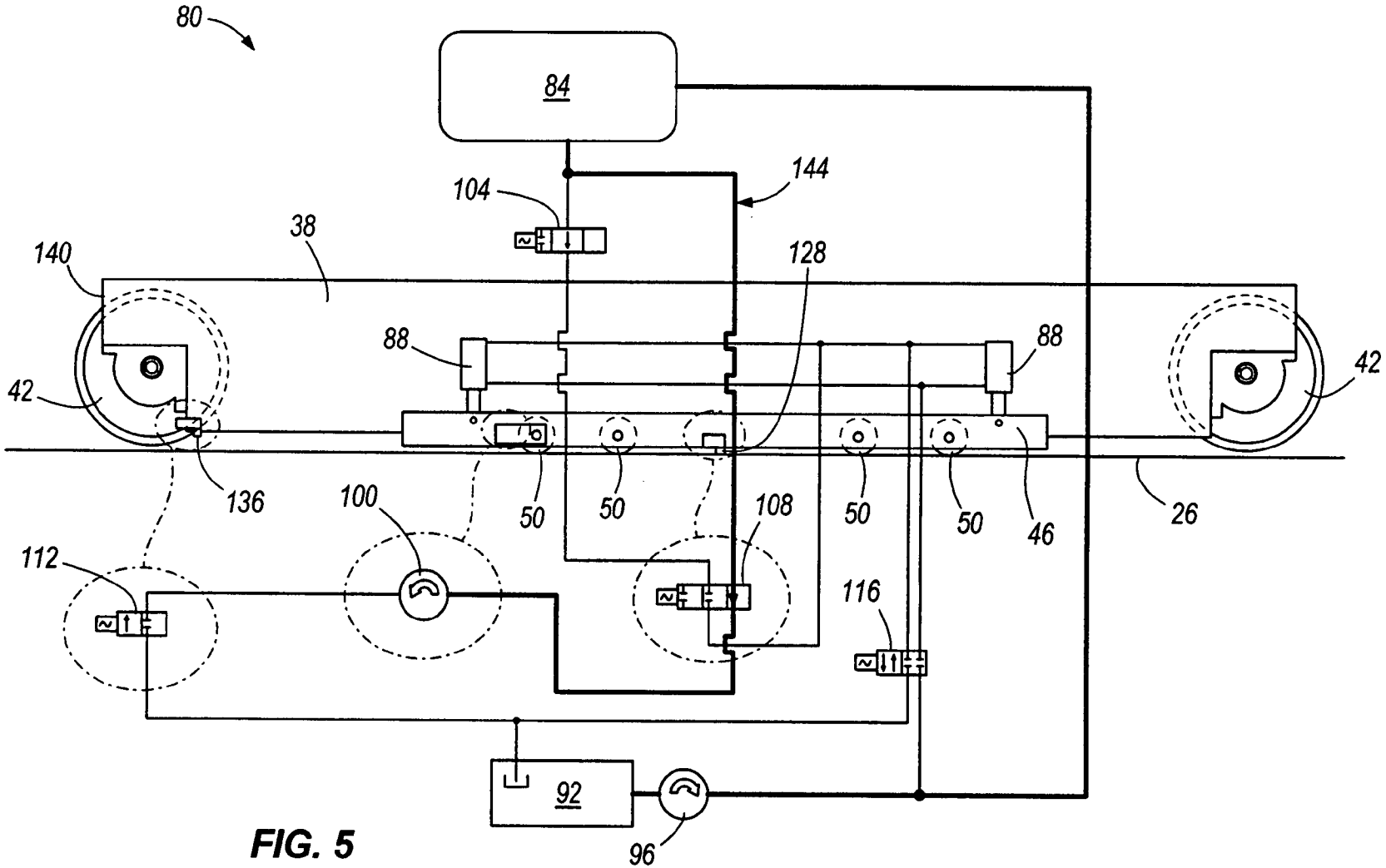

FIG. 5 illustrates the crane return system 80 after the crane 10 reaches the home position. A home position limit switch is 136 coupled to the home position valve 112 and positioned proximate an end 140 of the bridge 18. In the illustrated embodiment, the home position limit switch 136 is located on the main end truck 38 proximate the main wheel 42 closest to the home position. When the crane 10, and in particular the bridge 18, reaches the home position, the home position limit switch 136 is activated. The home position limit switch 136 may be activated in a number of ways, including, but not limited to, contact with the home position or contact with an object at the home position. The home position limit switch 136 actuates the normally-open home position valve 112 to a closed position, which stops flow of hydraulic fluid from the hydraulic fluid pressure vessel 84 to the hydraulic drive motor 100. Once the drive motor 100 is de-energized, the auxiliary drive wheels 50 stop rotating.

A hydraulic fluid flow path 142 is shown by the solid, bold line in FIG. 5. During this phase of the crane return, the power loss valve 104 remains open and the wheel down valve 108 is positioned to allow hydraulic fluid to flow from the hydraulic fluid pressure vessel 84 toward the hydraulic drive motor 100, however, it should be noted the home position valve 112 prevents hydraulic fluid from flowing to the drive motor 100. Similar to the status of the crane return system 80 when power is supplied to the crane 10, hydraulic fluid is pumped to the fluid pressure vessel 84 from the hydraulic fluid reservoir 92 and once the fluid pressure vessel 84 is full, a pressure relief valve reroutes hydraulic fluid back to the fluid reservoir 92. The system reset valve 116 remains in its initial position to prevent hydraulic fluid from flowing from the fluid reservoir 92 to the hydraulic cylinders 88. In another embodiment, the power loss valve 108 is actuated to the closed position and the wheel down valve 108 is actuated to a position to prevent flow of hydraulic fluid from the pressure vessel 84 to the drive motor 100.

Figure 6:
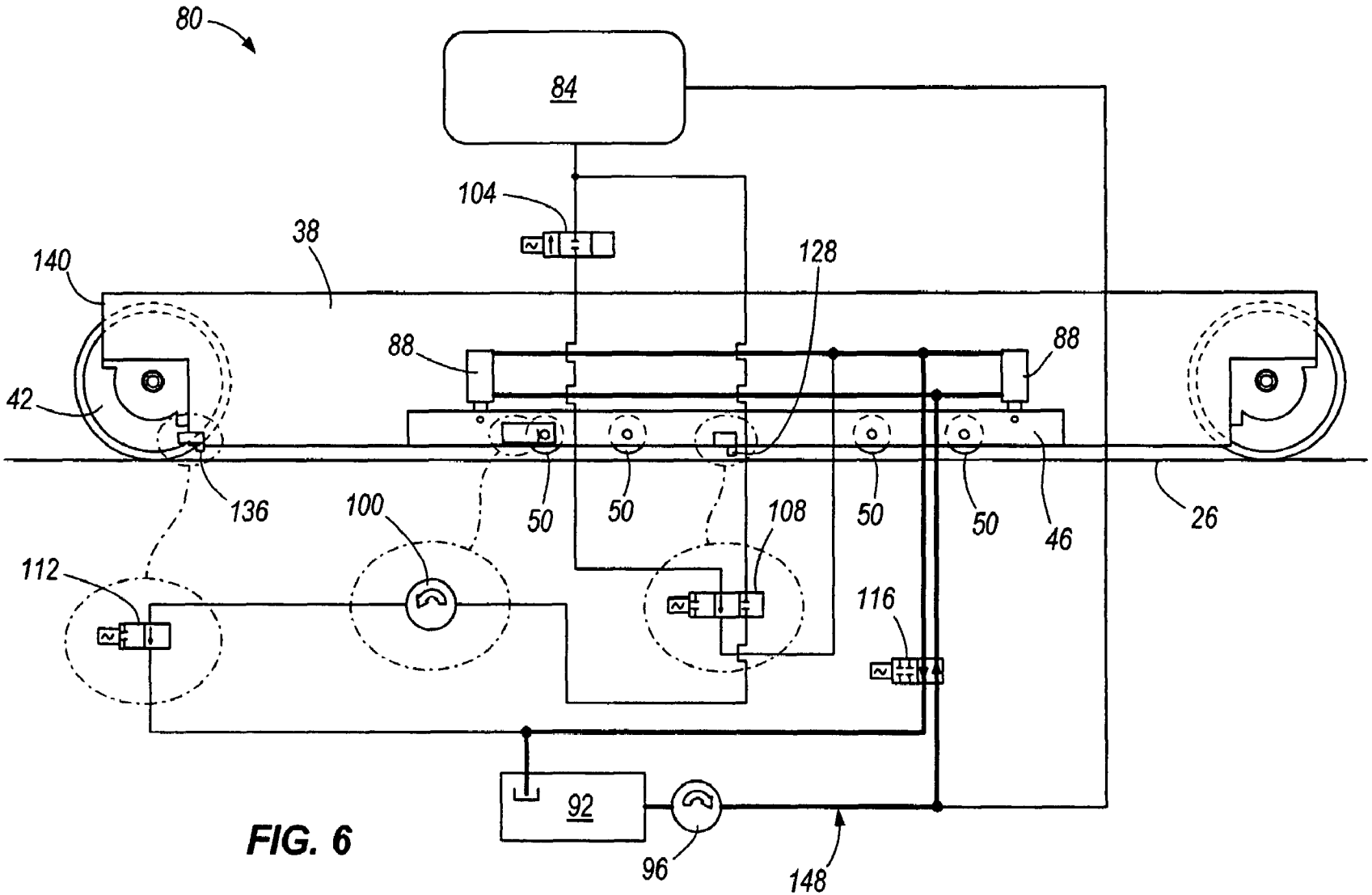

FIG. 6 illustrates the crane return system 80 subsequent to restoration of power to the crane 10. When power is restored to the crane 10, hydraulic fluid is used to retract the hydraulic cylinders 88 and move the auxiliary end truck 46 and auxiliary drive wheels 50 back to the first position, i.e., recessed from the rail 26 of the main support beam 22. The power loss valve 104 is actuated back to the closed position, the home position valve 112 is actuated back to the open position and the wheel down valve 108 is actuated to prevent flow of hydraulic fluid from the hydraulic pressure vessel 84 to the hydraulic drive motor 100. Thus, hydraulic fluid is prevented from flowing to the cylinders 88 from the fluid pressure vessel 84 to extend the cylinders 88, and to the drive motor 100

During this phase of the crane return, the normally-closed system reset valve 116 is actuated open, i.e., to a second position, such that hydraulic fluid flows between the hydraulic fluid reservoir 92 and the hydraulic cylinders 88. The pump 96 pumps hydraulic fluid from the fluid reservoir 92 to the cylinders 88, which thereby retract to pull the auxiliary end truck 46 and the auxiliary drive wheels 50 away from the bridge rail 26. After the hydraulic fluid cycles through the cylinders 88, the hydraulic fluid returns to the fluid reservoir 92. A hydraulic fluid flow path 148 is shown by the solid, bold line in FIG. 6.

Once the auxiliary drive wheels 50 are lifted from contact with the rail 26, the force lifting the main end truck 38 and the main wheels 42 from the rail 26 is released. Thereby, the main end truck 38 returns to its initial position and the main wheels 42 are in contact with the rail 26 to travel along the rail 26 and move the bridge 18 along the main support beams 22. Once the main wheels 42 and the auxiliary drive wheels 50 return to the respective initial positions, the system reset valve 116 is actuated back to its initial closed position, whereby hydraulic fluid cannot flow between the hydraulic fluid reservoir 92 and the hydraulic cylinders 88. This phase of the crane return is illustrated in FIG. 2.

The crane return system 80 discussed above is described for use when a loss of power occurs to the crane 10, such as when there is a power failure to the crane 10 or power is purposefully cut to the crane 10 (e.g., when mechanical failure occurs or a crane component breaks) so that the crane return system 80 will automatically return the crane 10 to the home position. Once power is restored to the crane 10 (e.g., power is turned back on or necessary repairs are completed on the crane), the crane return system is reset and disabled, and the crane 10 will operate with its main components.

The crane return system 80 facilitates retrieval of a disabled crane from areas that people cannot enter because of radioactive or hazardous material. In particular, when power is lost to the crane 10, the crane return system 80 is able to operate and return the crane 10 to a home position because the crane return system 80 does not rely upon electrical power. Instead, the crane return system 80 uses potential energy converted to kinetic energy through the storage of pressurized hydraulic fluid. The valves are mechanically actuated such that a retrieval sequence is activated to return the crane 10 to a home position.

The embodiment of the crane return system discussed above describes one auxiliary end truck interconnected with one main end truck of the crane bridge. However, it should be readily apparent to one of skill in the art that each main end truck of the bridge includes an auxiliary end truck positionable by the crane return system to move the bridge upon a loss of power. In a further embodiment of a crane including a trolley (or second bridge), the crane return system includes auxiliary end trucks with auxiliary drive wheels interconnected with the trolley end trucks. Thus, upon a loss of power, the crane return system positions the auxiliary drive wheels to move the trolley to a home position using the crane return system and sequence of operations described above. The present invention crane return system can be adapted for use with any number of types of cranes for returning a crane to a home position.

What is claimed is:

1. A crane return system for returning a crane component to a home position when there is a loss of power, a crane including a bridge adapted to travel along at least one rail and including a plurality of main wheels to travel along the rail, the crane return system comprising:

a plurality of auxiliary drive wheels supported by the bridge, the auxiliary drive wheels movable relative to the bridge between a first position, in which the auxiliary drive wheels are each recessed from the rail and the main wheels are each in contact with the rail, and a second position, in which the auxiliary drive wheels are each in contact with the rail and the main wheels are each recessed from the rail, wherein when power is supplied to the crane the auxiliary drive wheels are in the first position;

a hydraulic fluid pressure vessel for storing hydraulic fluid, wherein a substantially fixed mass of hydraulic fluid is contained within the crane return system;

a hydraulic cylinder interconnected with the auxiliary drive wheels and selectively fluidly communicating with the hydraulic fluid pressure vessel, wherein when power is lost to the crane, hydraulic fluid is supplied to the hydraulic cylinder to extend the hydraulic cylinder and thereby move each the auxiliary drive wheels from the first position to the second position; and a drive motor interconnected with the auxiliary drive wheels and selectively fluidly communicating with the hydraulic fluid pressure vessel, wherein when the auxiliary drive wheels are in the second position, hydraulic fluid is diverted from the hydraulic cylinder and supplied to the drive motor to rotate the auxiliary drive wheels and move the bridge toward a home position.

2. The crane return system of claim 1, and further comprising a normally-closed power loss valve in fluid communication with the hydraulic fluid pressure vessel and interconnected with a power source, wherein when power is lost to the crane the power loss valve opens to allow hydraulic fluid to flow from the hydraulic fluid pressure vessel to the hydraulic cylinder.

3. The crane return system of claim 1, and further comprising a wheel down valve in fluid communication with the hydraulic fluid pressure vessel, wherein when the auxiliary drive wheels make contact with the rail the wheel down valve is actuated to allow hydraulic fluid to flow from the hydraulic fluid pressure vessel to the drive motor.

4. The crane return system of claim 3, and further comprising a wheel down limit switch coupled to the wheel down valve, wherein upon contact of the wheel down limit switch with the at least one rail, the wheel down limit switch actuates the wheel down valve to allow hydraulic fluid to flow from the hydraulic fluid pressure vessel to the drive motor.

5. The crane return system of claim 1, and further comprising a normally-open home position valve in fluid communication with the drive motor, wherein when the bridge reaches the home position the home position valve closes to stop the flow of hydraulic fluid to the drive motor and thereby stop rotation of the auxiliary drive wheels.

6. The crane return system of claim 5, and further comprising a home position limit switch coupled with the home position valve, wherein upon contact of the home position limit switch with the home position, the home position limit switch actuates the home position valve closed.

7. The crane return system of claim 1, and further comprising a normally-closed reset valve in fluid communication with the hydraulic cylinder, wherein when power is restored to the crane after loss of power the reset valve opens to allow hydraulic fluid to flow to and from the hydraulic cylinder to retract the hydraulic cylinder and thereby move the auxiliary drive wheels from the second position to the first position.

8. The crane return system of claim 1, and further comprising a hydraulic fluid reservoir in fluid communication with the hydraulic cylinder, the drive motor and the hydraulic fluid pressure vessel, the hydraulic fluid reservoir for receiving hydraulic fluid from the hydraulic cylinder and the drive motor and for delivering hydraulic fluid to the hydraulic fluid pressure vessel.

9. The crane return system of claim 8, and further comprising a pump to pump hydraulic fluid from the hydraulic fluid reservoir to the hydraulic fluid pressure vessel.

10. A crane comprising:

a bridge adapted to travel along a pair of rails, the bridge including a plurality of main wheels and a plurality of auxiliary drive wheels, the auxiliary drive wheels movable relative to the bridge between a first position, in which the auxiliary drive wheels are each recessed from the rails and the main wheels are each in contact with the rail when power is supplied to the crane, and a second position, in which the auxiliary drive wheels are each in contact with the rails and the main wheels are each recessed from the rail when power is off to the crane;

a hydraulic fluid pressure vessel filled with hydraulic fluid;

a hydraulic cylinder interconnected with the auxiliary drive wheels and selectively fluidly connected with the hydraulic fluid pressure vessel, wherein when power is lost to the crane, hydraulic fluid is delivered from the hydraulic fluid pressure vessel to the hydraulic cylinder to extend the hydraulic cylinder and thereby move each of the auxiliary drive wheels from the first position to the second position; and a drive motor interconnected with the auxiliary drive wheels and selectively fluidly connected with the hydraulic fluid pressure vessel, wherein when the auxiliary drive wheels are in the second position, hydraulic fluid is diverted from the hydraulic cylinder and delivered from the hydraulic fluid pressure vessel to the drive motor to rotate the auxiliary drive wheels and move the bridge toward a home position.

11. The crane return system of claim 10 wherein as the auxiliary drive wheels contact the rails, the main wheels are lifted from contact with the rails.

12. The crane return system of claim 10, and further comprising a normally-closed power loss valve in fluid communication with the hydraulic fluid pressure vessel and interconnected with a power source, wherein when power is lost to the crane the power loss valve opens to allow hydraulic fluid to flow from the hydraulic fluid pressure vessel to the hydraulic cylinder.

13. The crane return system of claim 10, and further comprising a wheel down valve in fluid communication with the hydraulic fluid pressure vessel, wherein when the auxiliary drive wheels are in the second position the wheel down valve is actuates to allow hydraulic fluid to flow from the hydraulic fluid pressure vessel to the drive motor.

14. The crane return system of claim 13, and further comprising a wheel down limit switch coupled to the wheel down valve, wherein upon contact of the wheel down limit switch with one of the rails, the wheel down limit switch actuates the wheel down valve to allow hydraulic fluid to flow from the hydraulic fluid pressure vessel to the drive motor.

15. The crane return system of claim 10, and further comprising a normally-open home position valve in fluid communication with the drive motor, wherein when the bridge reaches the home position the home position valve closes to stop the flow of hydraulic fluid to the drive motor and thereby stop rotation of the auxiliary drive wheels.

16. The crane return system of claim 15, and further comprising a home position limit switch coupled with the home position valve, wherein upon contact of the home position limit switch with the home position, the home position limit switch actuates the home position valve closed.

17. The crane return system of claim 10, and further comprising a normally-closed reset valve in fluid communication with the hydraulic cylinder, wherein when power is restored to the crane after loss of power the reset valve opens to allow hydraulic fluid to flow to and from the hydraulic cylinder to retract the hydraulic cylinder and thereby move the auxiliary drive wheels from the second position to the first position.

18. The crane return system of claim 10, and further comprising a hydraulic fluid reservoir in fluid communication with the hydraulic cylinder, the drive motor and the hydraulic fluid pressure vessel, the hydraulic fluid reservoir for receiving hydraulic fluid from the hydraulic cylinder and the drive motor and for delivering hydraulic fluid to the hydraulic fluid pressure vessel.

19. The crane return system of claim 18, and further comprising a pump to pump hydraulic fluid from the hydraulic fluid reservoir to the hydraulic fluid pressure vessel.

20. A method for returning a crane component to a home position upon a loss of power to a crane, the crane including a bridge adapted to travel along at least one rail with a plurality of main wheels in contact with the rail and a plurality of auxiliary drive wheels recessed from the rail, the method comprising:

supplying and storing hydraulic fluid in a hydraulic fluid pressure vessel;

upon a loss of power to the crane, supplying hydraulic fluid from the hydraulic fluid pressure vessel to a hydraulic cylinder interconnected with the auxiliary drive wheels, the hydraulic cylinder extending to move each of the auxiliary drive wheels into contact with the rail;

removing the main wheels from contact with the rail when the auxiliary drive wheels are moved into contact with the rail;

supplying hydraulic fluid from the hydraulic fluid pressure vessel to a drive motor when the auxiliary drive wheels contact the rail to drive the auxiliary drive wheels such that the bridge travels along the rail toward the home position, wherein hydraulic fluid is diverted from the hydraulic cylinder; and stopping the flow of hydraulic fluid to the drive motor when the bridge reaches the home position to thereby stop the auxiliary drive wheels.

21. The method of claim 20 wherein supplying hydraulic fluid to the hydraulic cylinder comprises opening a normally-closed power loss valve to allow hydraulic fluid to flow from the hydraulic fluid pressure vessel to the hydraulic cylinder, wherein the power loss valve is in fluid communication with the hydraulic fluid pressure vessel and interconnected with a power source.

22. The method of claim 20 wherein supplying hydraulic fluid to the drive motor comprises actuating a wheel down to allow hydraulic fluid to flow from the hydraulic fluid pressure vessel to the drive motor, wherein the wheel down valve is in fluid communication with the hydraulic fluid pressure vessel.

23. The method of claim 20 wherein stopping flow of hydraulic fluid to the drive motor comprises closing a normally-open home position to stop flow of hydraulic fluid to the drive motor and thereby stop rotation of the auxiliary drive wheels, wherein the home position valve is in fluid communication with the drive motor.

24. The method of claim 20, and further comprising:

restoring power to the crane; and retracting the auxiliary drive wheels away from contact with the rail.

25. The method of claim 20, wherein retracting the auxiliary drive wheels comprises opening a normally-closed reset valve to allow fluid to flow to and from the hydraulic cylinder to retract the hydraulic cylinder and thereby move the auxiliary drive wheels away from contact with the rail, wherein the reset valve is in fluid communication with the hydraulic cylinder.

* * * * *